US005929617A

United States Patent [19]

Brokaw

[11] Patent Number: 5,929,617

[45] Date of Patent: Jul. 27, 1999

[54] LDO REGULATOR DROPOUT DRIVE REDUCTION CIRCUIT AND METHOD

[75] Inventor: A. Paul Brokaw, Burlington, Mass.

[73] Assignee: Analog Devices, Inc., Norwood, Mass.

[21] Appl. No.: 09/034,896

[22] Filed: Mar. 3, 1998

[51] Int. Cl.[6] ..... G05F 1/40

[52] U.S. Cl. ..... 323/280

[58] Field of Search ..... 323/280, 281, 323/275; 327/540

[56] References Cited

U.S. PATENT DOCUMENTS

| | | | |
|---|---|---|---|
| 4,731,574 | 3/1988 | Melbert | 323/275 |
| 5,631,598 | 5/1997 | Miranda et al. | 327/540 |
| 5,677,558 | 10/1997 | McGlinchey | 327/564 |

*Primary Examiner*—Shawn Riley
*Attorney, Agent, or Firm*—Koppel & Jacobs

[57] ABSTRACT

An low dropout voltage regulator (LDO) drive reduction circuit detects when the LDO's output voltage is going out of regulation due to a falling input voltage while the output is lightly loaded, and reduces the drive to the pass transistor in response. This action prevents the LDO's ground current from rising unnecessarily. The drive reduction circuitry directly monitors the voltage across the pass transistor; when above a predetermined threshold voltage which is typically well-below the LDO's specified dropout voltage, the pass transistor drive is permitted to vary as necessary to maintain a specified output voltage. If the monitored voltage falls below the threshold voltage, indicating that the input voltage is falling and the output is lightly loaded, the drive reduction circuit reduces the drive current, which would otherwise get increased in an attempt to restore the output voltage. The transconductance of the novel drive reduction circuit is relatively high, making the region over which the drive reduction circuit is active small and permitting the threshold voltage to be precisely set.

13 Claims, 4 Drawing Sheets

LDO REGULATOR DROPOUT DRIVE REDUCTION CIRCUIT AND METHOD

BACKGROUND OF THE INVENTION

1. Field of the Invention

This invention relates to the field of drive current reduction circuits, particularly circuits used to limit the drive current supplied to a low dropout voltage regulator's pass transistor.

2. Description of the Related Art

A basic "low dropout" voltage regulator (LDO) is shown in FIG. 1. Voltage regulators of this type provide a desired regulated output voltage as long as the input voltage is higher than the desired output voltage by at least the "dropout" voltage, typically about 100 mv. An input voltage $V_{in}$ is connected to the emitter 10 of a "pass transistor" 12, typically a pnp bipolar transistor, and an output voltage $V_{out}$ is taken at the transistor's collector 14 and drives a load $R_{load}$. The output voltage is regulated by controlling pass transistor 12 via its control input 16. Regulation is accomplished with a feedback loop: the output voltage is fed back to the non-inverting input 18 of a loop amplifier 20, usually via a voltage divider 22. A voltage reference $V_{ref}$ is connected to the inverting input 24 of the amplifier. The amplifier's output is connected to the pass transistor's control input 16.

In operation, amplifier 20 drives the pass transistor as necessary to make the voltage at its inputs 18 and 24 equal, thereby holding the output voltage at a constant value proportional to the reference voltage. Unequal voltages at inputs 18 and 24 indicate that the output voltage is going out of regulation, and the amplifier adjusts the drive to restore the output to its desired value.

Two possible causes for the output voltage going out of regulation are: 1)a load current which exceeds the regulator's capabilities is demanded by load $R_{load}$, and 2)a falling input voltage causes the voltage across the pass transistor to fall below the dropout voltage—a common occurrence for a battery-powered regulator as its battery nears discharge. In either case, the amplifier tries to restore the output by calling for more drive. When a falling input voltage is the cause and the regulator is lightly loaded, the increase in drive current may greatly exceed the actual load current. This is undesirable in battery applications: for example, suddenly increasing the load on the battery as it nears discharge can shorten its life.

One technique for reducing excessive drive current is to connect a diode across the base-collector junction of pass transistor 16. The diode, with its anode connected to the transistor's base, becomes forward-biased when $V_{in}$ and $V_{out}$ get sufficiently close together, reducing the drive to pass transistor 12 below that provided by amplifier 20. One disadvantage of this solution is that drive current is reduced regardless of the cause of the low differential voltage across transistor 12. Under some conditions, when $V_{in}$ is falling and the output is lightly loaded, for example, it may be desirable to allow the differential to fall lower than the point at which the diode begins conducting without affecting the transistor's drive. Another disadvantage is that the regulator's ground current will increase when amplifier 20 calls for more drive and the diode is conducting. Since ground current is power consumed from the source of $V_{in}$ such as a battery, it is desirable that it be kept as low as possible.

Another approach that has been taken is shown in FIG. 1. A transistor 26, shown here as a pnp, is connected across pass transistor 12: the base of transistor 26 is connected to the base of transistor 12, its emitter is connected to $V_{oUt}$, and its collector is connected to amplifier 20 and arranged to reduce the drive to transistor 12 when transistor 26 is conducting. As with the diode, the transistor begins conducting when $V_{in}$ and $V_{out}$ get sufficiently close. However, this solution can also become active at a higher-than-desired differential voltage, causing the drive to be reduced while the regulator is still capable of maintaining the output voltage.

SUMMARY OF THE INVENTION

An LDO drive reduction circuit and method are presented that detect when an LDO regulator is going out of regulation due to a falling input voltage while its output is lightly loaded, and which reduces the drive to the LDO's pass transistor in response. This action prevents the regulator's ground current from rising unnecessarily and thereby extends the life of the battery powering the regulator.

The drive reduction circuit is connected to directly monitor the voltage across the pass transistor. When the monitored voltage is above a predetermined threshold voltage which is typically well-below the LDO's specified dropout voltage, the drive to the pass transistor is permitted to vary as necessary to maintain a desired output voltage. However, if the monitored voltage falls below the threshold voltage, indicating that the input voltage is falling and the output is lightly loaded, the circuit acts to reduce the drive current which would otherwise get increased in an attempt to restore the desired output voltage.

In a preferred embodiment, a first transistor is connected to the regulator's input voltage and provides a bias current to the pass transistor's drive circuit; under normal conditions, the transistor operates in saturation and supplies a bias current to the drive circuit sufficient to allow the drive current to vary as needed to maintain a desired output voltage. A second transistor is connected to the regulator's output voltage. The two transistors are arranged such that when the voltage across the pass transistor drops below a settable threshold, the second transistor is turned on and begins to modulate the first transistor, reducing the bias current to the drive circuit and thereby limiting the drive current. The transconductance of the novel drive reduction circuit is relatively high, making the region over which the circuit is active small and permitting the threshold to be precisely set.

Further features and advantages of the invention will be apparent to those skilled in the art from the following detailed description, taken together with the accompanying drawings.

DETAILED DESCRIPTION OF THE INVENTION

Figure 2:
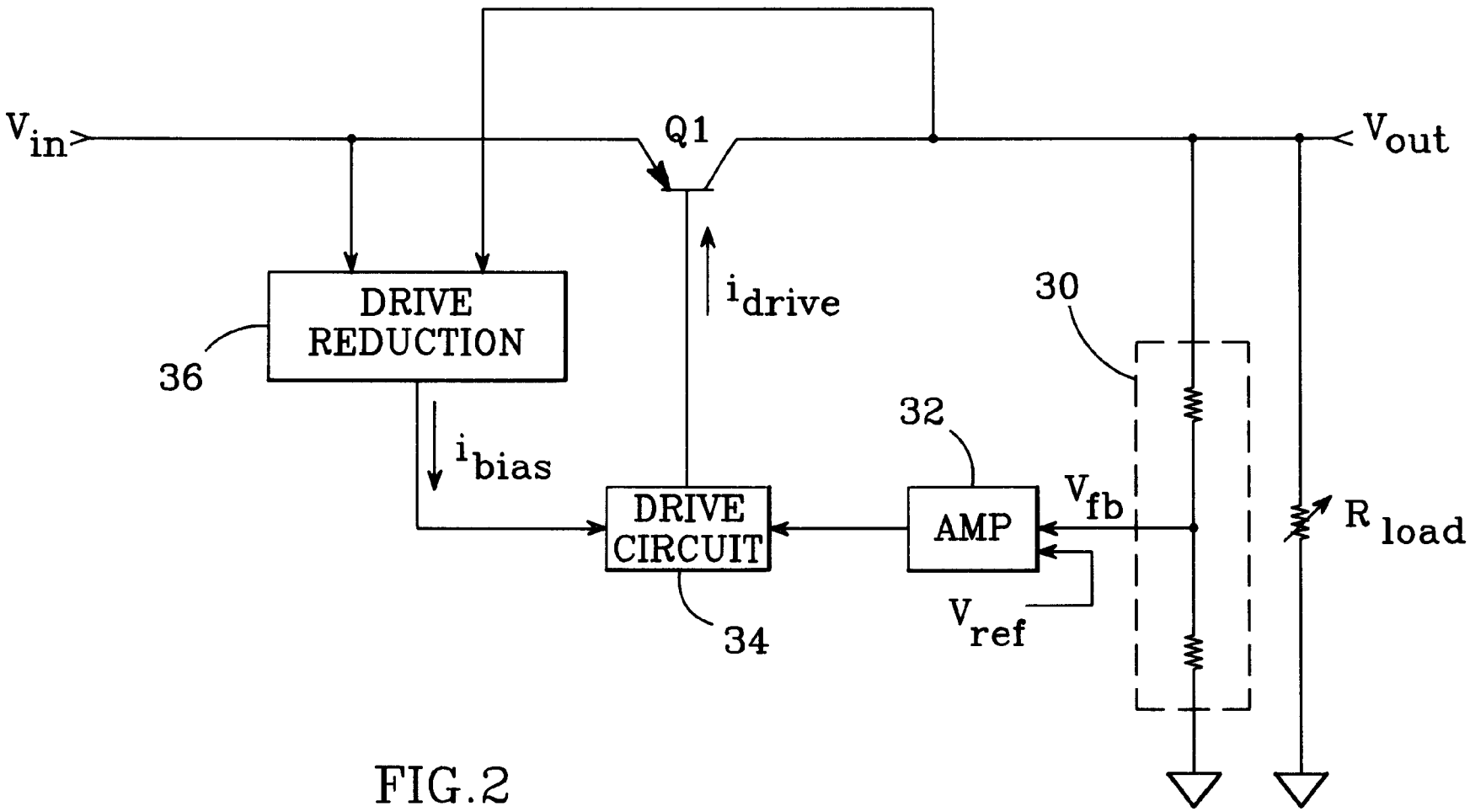
FIG. 2 is a block diagram of an LDO drive reduction circuit per the present invention.

An LDO which includes a circuit that reduces the drive current to the LDO's pass transistor when the voltage across the transistor drops below a particular threshold is shown in FIG. 2. Pass transistor Q1 receives an input voltage $V_{in}$ at its emitter and produces a specified output voltage $V_{out}$ at its collector, which is connected to drive a load $R_{load}$. $V_{out}$ is regulated with a feedback loop that includes a divider network 30, a loop amplifier 32, and a drive circuit 34. Divider network 30 divides down $V_{out}$ to produce an output $V_{fb}$ which is fed to amplifier 32. The amplifier compares $V_{fb}$ with a reference voltage $V_{ref}$. and outputs an error voltage based on the difference between them to the drive circuit 34. Under normal conditions, drive circuit 34 supplies a drive current $i_{drive}$ to Q1 necessary to reduce the error voltage toward zero; in this way, $V_{out}$ is maintained at a known multiple of $V_{ref}$. "Normal conditions" are present when $V_{in}$ is greater than $V_{out}$ by a minimum amount referred to as the "dropout voltage" $V_{do}$, which is determined by the voltage at which Q1 saturates and specified at a particular output current level. The specified $V_{out}$ cannot be guaranteed when the voltage across Q1, i.e., $V_{Q1}$, drops below $V_{do}$.

The amount of drive current $i_{drive}$ which drive circuit 34 can output is controlled by a bias current $i_{bias}$, which it receives from a drive reduction circuit 36. Drive reduction circuit 36 is connected directly across pass transistor Q1 and receives $V_{in}$ and $V_{out}$ as inputs, and produces $i_{bias}$ as an output. Drive reduction circuit 36 works as follows: $V_{Q1}$ is continuously monitored. When $V_{Q1}$ is above a predetermined threshold $V_{th}$, drive reduction circuit 36 outputs bias current $i_{bias}$ to drive circuit 34 sufficient to allow drive current $i_{drive}$ to vary up to an absolute maximum value $i_{max}$ if needed to maintain the specified $V_{Out}$. If $V_{Q1}$ falls below $V_{th}$, however, drive reduction circuit 36 responds by reducing bias current $i_{bias}$, which reduces the maximum amount of drive current that can be supplied to Q1.

If input voltage $V_{in}$ is falling toward $V_{out}$, Q1 will eventually saturate, so that further increases in drive current produce little or no increase in output current. The $V_{Q1}$ at which saturation occurs is dependent on the load being driven, with saturation occurring at lower values of $V_{Q1}$ for lower output current levels. For example, dropout may occur at a $V_{Q1}$ of 100 mv at the rated output current, but at a $V_{Q1}$ of only 5 or 10 mv when the regulator is lightly loaded. As such, it is very likely that if $V_{Q1}$ falls well below the dropout voltage specified at the rated output current, it is because the LDO's output is lightly loaded and the input voltage is falling. The drive reduction circuit 36 uses this relationship to indicate the presence of a falling input/lightly loaded condition. Thus, $V_{th}$, the pass transistor voltage at which drive reduction circuit 36 becomes active, is set to a value well below the specified dropout voltage $V_{dO}$. This insures that the reduction circuit acts only upon detection of the falling input/lightly loaded condition, and does not interfere with the normal operation of the LDO when $V_{Q1}$ is equal to or greater than $V_{dO}$. A falling input voltage is typically found in LDO's powered by a battery, as the battery nears discharge. Reducing the drive current when this falling input/lightly loaded condition is present prevents the regulator's ground current from rising unnecessarily and thereby extends the life of the battery powering the regulator.

Figure 3:
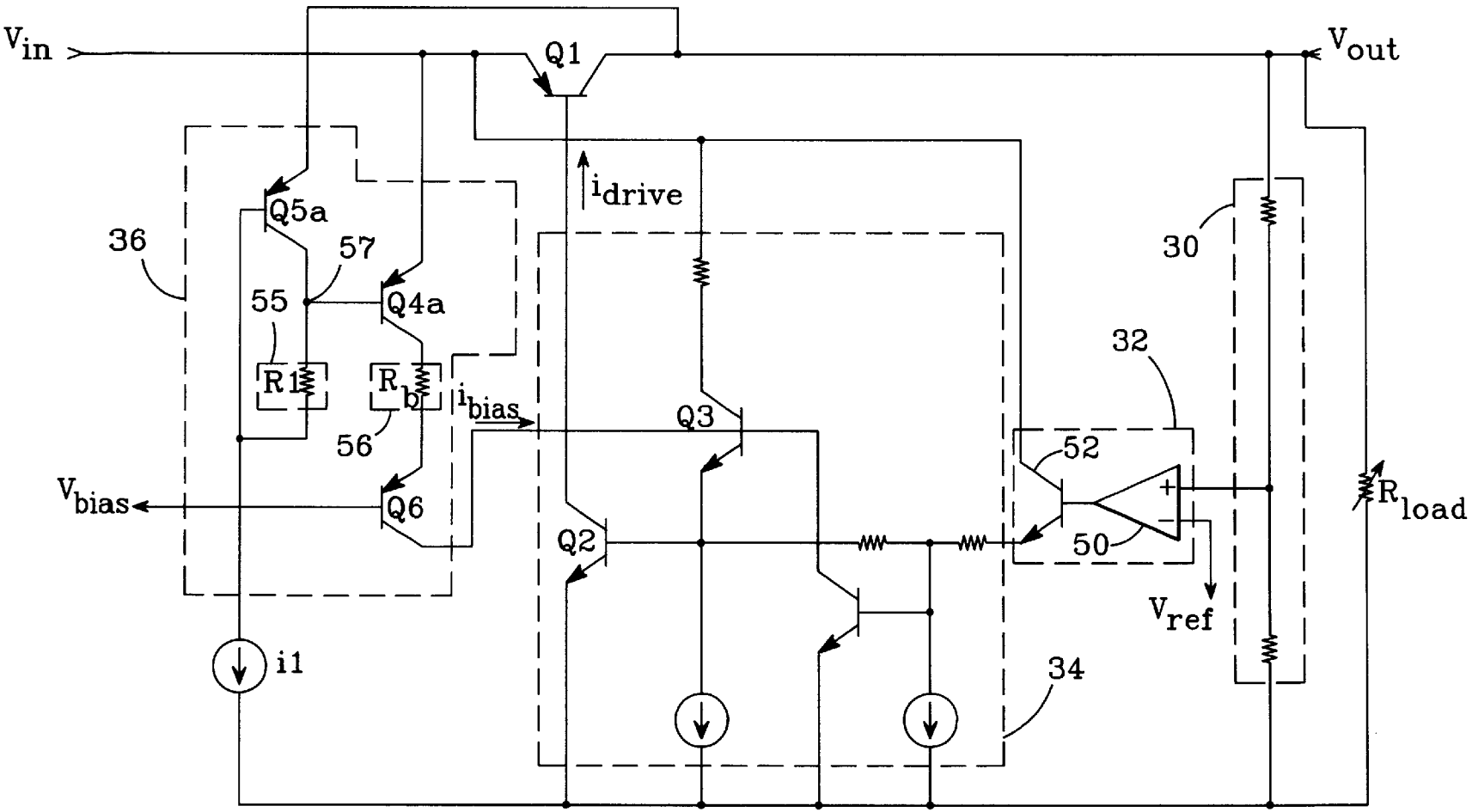
FIG. 3 is a schematic diagram of an LDO drive reduction circuit per the present invention.

A more detailed embodiment of an LDO employing the present drive reduction circuit is shown in FIG. 3. Loop amplifier 32 preferably includes an amplifier 50 which drives an emitter follower 52, which in turn feeds drive circuit 34. Drive circuit 34 is preferably a non-inverting amplifier which includes an npn drive transistor Q2 connected to supply drive current $i_{drive}$ to pnp pass transistor Q1. The maximum amount of drive current $i_{max}$ is governed by the voltage applied to Q2's base, which is set by a transistor Q3 that receives $i_{bias}$ at its base. Controlling Q2's base voltage via Q3 makes Q2's collector current, i.e., $i_{drive}$, a function of $i_{bias}$. The drive current $i_{drive}$ can thus be limited by reducing the bias current ibias supplied to the non-inverting amplifier by drive reduction circuit 36; reducing $i_{bias}$ reduces $i_{max}$.

Drive reduction circuit 36 is preferably comprised of bipolar transistors Q4*a*, Q5*a* and Q6, and "threshold" and "bias" resistances 55 and 56, respectively, which are preferably implemented with resistors R1 and $R_b$. Q4*a*'s emitter is connected to $V_{in}$ and its collector connected to one side of $R_b$. Q5*a*'s emitter is connected to $V_{out}$, and its collector is connected to Q4*a*'s base at a node 57. Resistor R1 is between node 57 and Q5*a*'s base, which is also connected to a current source i1. The other side of resistor $R_b$ is connected to the emitter of Q6; Q6's base is connected to a bias voltage $V_{bias}$ that is set with respect to $V_{in}$ and bias current $i_{bias}$ is produced at Q6's collector.

When $V_{Q1}$ is above $V_{th}$, i1 pulls down on the base of Q4*a* through R1, forward-biasing Q4*a*'s base-emitter junction and driving Q4*a* into saturation. While in saturation, Q4*a* acts like a switch, connecting the top of $R_b$ to $V_{in}$. The base of Q6 is set at voltage $V_{bias}$ that varies with $V_{in}$, so that the emitter of Q6 forces a controlled voltage across $R_b$. This causes a controlled current to flow in Q6, which is delivered to drive circuit 34 as $i_{bias}$ Having Q4*a* in saturation makes $i_{bias}$ as high as it can be, enabling drive circuit 34 to vary $i_{drive}$ up to $i_{max}$.

When $V_{Q1}$ is above $V_{th}$, transistor Q5*a* is off: its base voltage is equal to $V_{in}$ minus the $V_{be}$ of Q4*a* ($V_{be4a}$) minus the voltage drop across R1 (i.e., $V_{R1}$=i1×R1), while its emitter is at the LDO's output voltage $V_{out}$. For example, $V_{in}-V_{be4a}-(i1\times R1)$ might equal 5–0.7–(0.001 ×100)=4.2 volts. If $V_{out}$ is at 3 volts, Q5*a*'s base-emitter junction is reverse-biased and Q5*a* is kept off.

As $V_{in}$ starts to fall, Q5*a*'s base-emitter junction will become zero-biased (when $V_{in}$ drops to 3.8 volts in the above example), and starts to become forward-biased as $V_{in}$ falls further. Q5*a* starts to come on, supplying some of the i1 current and thereby stealing away some of the current that keeps Q4*a* saturated and pulling Q4*a* out of saturation. This reduces the current available to Q6 through $R_b$, and this reduction in $i_{bias}$ in turn limits the maximum amount of drive current that can be supplied to Q1.

If $V_{in}$, has fallen so low that $V_{out}$ has been dragged below the regulator's specified output voltage, the loop amplifier 32 will eventually demand that all available drive current be supplied to Q1 to restore $V_{out}$. By reducing bias current $i_{bias}$, the drive reduction circuit reduces the maximum amount of drive current that can be supplied to Q1, preventing the delivery of excessive load current to the light load and reducing the draw on a battery that is probably near discharge. The regulator's ground current, all of which is drawn from the battery, is also kept from rising unnecessarily.

The voltage across pass transistor Q1 at which Q4*a*begins to be modulated is determined by the value of $V_{R1}$. If we neglect R1, Q4*a* mirrors the current through Q5*a* when Q5*a* is active. R1 serves to shift node 57 down, so that Q4*a* mirrors the current in Q5*a* when $V_{in}-V_{out}=V_{R1}$. Once this point is reached, $i_{bias}$ is continually reduced as the voltage across Qi falls. The drive reduction circuit's trigger point Vth is thus determined by the value of $V_{R1}$, which, assuming a known value for i1, is set by selecting an appropriate value for R1. Current source i1 must produce a well-controlled and known current for $V_{th}$ to be set accurately.

Figure 1:
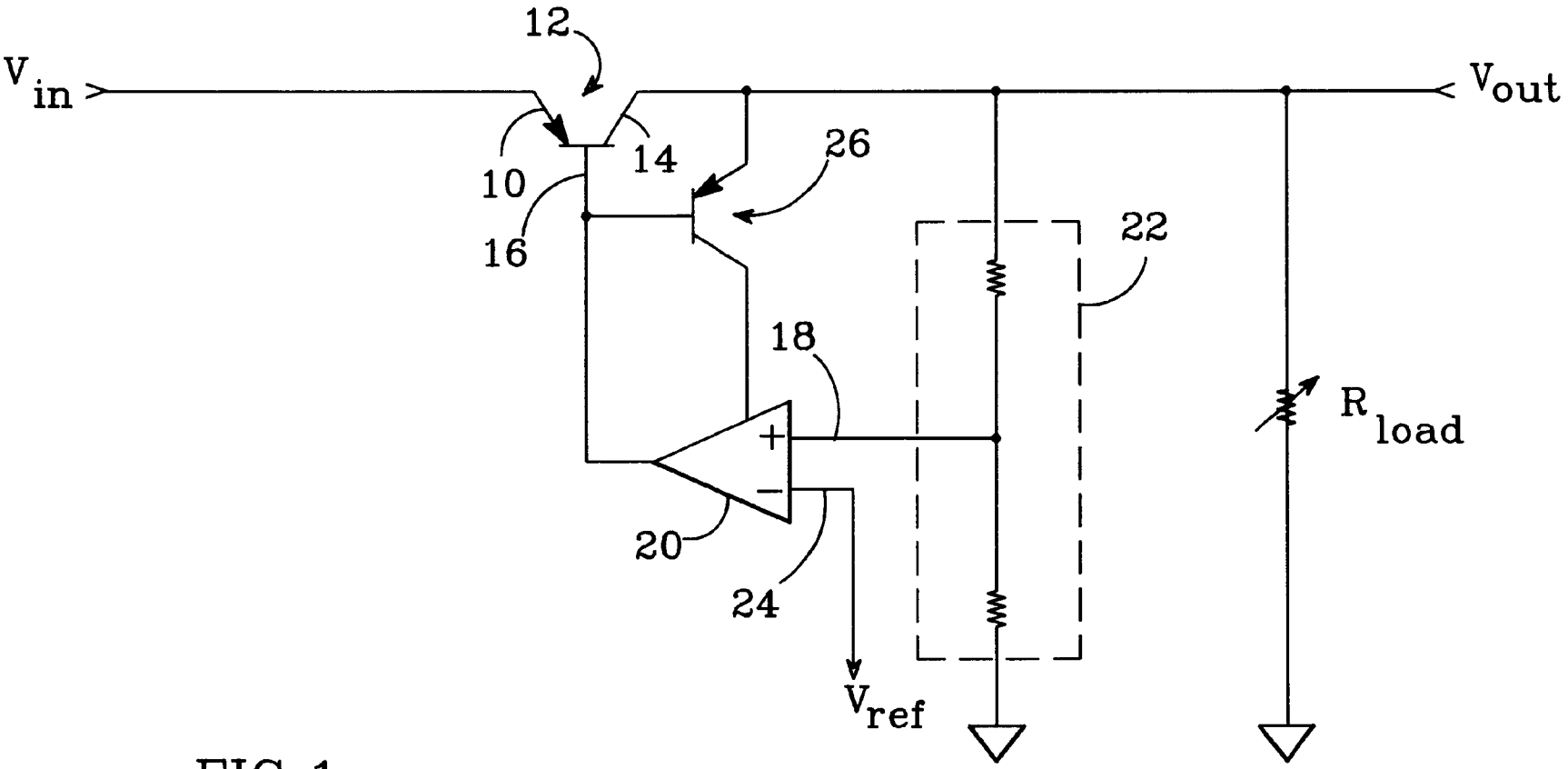
FIG. 1 (Prior Art)
FIG. 1 is a schematic diagram of a prior art LDO regulator.

The forward bias required to make Q5*a* draw appreciable current and pull Q4*a* out of saturation is balanced by the base voltage of Q5*a*, which it tracks over temperature and manufacturing variability. This makes the $V_{Q1}$ required to cause Q5*a* to conduct a well-defined and controllable design parameter which is only very weakly influenced by manufacturing and poorly predictable temperature variables. Moreover, because Q4*a* is normally operated as a saturated switch, the onset of conduction in Q5*a* has very little effect on the bias current produced by Q6. Only when the conduction of Q5*a* is large enough to reduce the current to Q4*a*'s base by a substantial amount does Q5*a* begin to limit the bias current and so reduce the maximum drive current. This is in contrast to prior art drive reduction circuits, in which any conduction of the device across the pass transistor (such as a diode or transistor 26 in FIG. 1) begins to reduce the drive current.

An appropriate value for $V_{th}$ will be application-specific. It should be less than the LDO's specified dropout voltage $V_{dO}$, to prevent the drive reduction circuit's interference with normal closed-loop regulator operation, but not so low as to not be triggered when the falling input/light load condition defined for the application is present. A typical $V_{th}$ value for an LDO with a rated output current of 100 ma and a dropout voltage $V_{dO}$ of 100 mv would be about 25 mv.

Once the current through Q4*a* begins to be modulated, Q4*a* and Q5*a* act like a differential bipolar pair, with a relatively high transconductance. This enables a small change in $V_{Q1}$ to cause a large change in Q5a's current, so that Q5*a* steals the drive from Q4*a* over a small range of $V_{Q1}$. Thus, the drive reduction circuit permits $V_{th}$ to be set fairly precisely, and makes the region over which the drive reduction circuit is active, small. Whereas prior art drive reduction schemes typically start acting at fairly high values of $V_{Q1}$ often adversely affecting LDO performance, the present drive reduction circuit is largely inactive until a much lower $V_{Q1}$ is reached.

Figure 4:
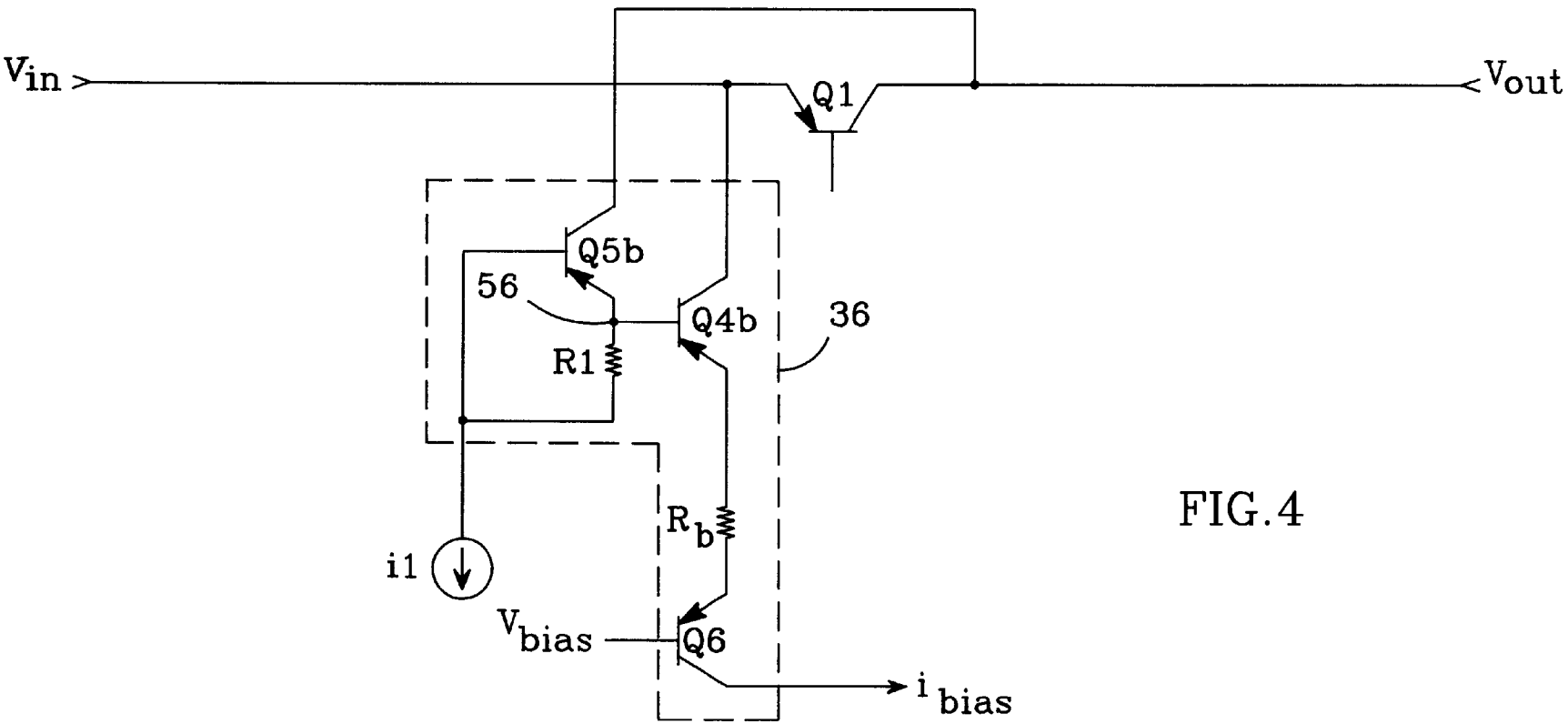
FIG. 4 is an alternative embodiment of the drive reduction circuit shown in FIG. 3.

A preferred embodiment of drive reduction circuit 36 is shown in FIG. 4. Transistors Q4*b* and Q5*b* are connected as Q4*a* and Q5*a* were in FIG. 3, but here are operated in their inverted mode. The terminals of Q4*b* and Q5*b* are shown in FIG. 4 as diffused, with the terminals diffused as collectors connected to $V_{in}$ and $V_{out}$, respectively. However, operated in their inverted mode, the diffused collectors act as emitters, and the diffused emitters function as collectors. Q5*b* is operated in inverted-mode to prevent breakdown: the breakdown voltage for a bipolar transistor's base-collector junction is much higher than for its base-emitter junction. Operating in inverted-mode enables Q4*b* to have a lower offset voltage when in saturation than is possible when operated in normal (non-inverted) mode. This is important because Q4*b* functions as a switch between $V_{in}$ and $R_b$, with a low offset voltage desirable. It is also desirable to operate Q4*b* inverted to match its mode of operation to that of Q5*b*.

While particular embodiments of the invention have been shown and described, numerous variations and alternate embodiments will occur to those skilled in the art. Accordingly, it is intended that the invention be limited only in terms of the appended claims.

I claim:

1. A dropout drive reduction circuit for reducing the magnitude of a current which drives a low dropout regulator's pass transistor when the regulator's input voltage is falling and its output is lightly loaded, comprising:

a pass transistor connected between a voltage input terminal and a voltage output terminal of a low dropout regulator, said pass transistor arranged to produce an output voltage at said output terminal in accordance with an input voltage applied at said input terminal and a drive current applied to said pass transistor's control input, a drive circuit which supplies said drive current to said pass transistor's control input, said drive circuit arranged to receive a bias current and to limit the maximum drive current delivered to said pass transistor in accordance with the magnitude of said bias current, a bias resistor, a first transistor having its current circuit connected between said input terminal and one terminal of said bias resistor, said first transistor conducting a current to said bias resistor in accordance with a first current applied at its control input, a second transistor having a current circuit connected between the second terminal of said bias resistor and said drive circuit, said second transistor biased with a voltage that varies with the voltage at said input terminal, said first and second transistors forcing a voltage across said bias resistor to produce said bias current, said second transistor conducting said bias current to said drive circuit, and a third transistor having a current circuit connected between said output terminal and said first transistor's control input, said third transistor arranged to conduct a second current to said first transistor's control input when the voltage across said input and output terminals falls below a predetermined threshold voltage, said second current reducing the magnitude of said first current and thereby modulating the current conducted to said bias resistor by said first transistor, said modulating of said current to said bias resistor reducing the magnitude of said bias current and thereby lowering said maximum drive current limit.

2. The dropout drive reduction circuit of claim 1, wherein said first transistor is a bipolar transistor and said first current is of sufficient magnitude to drive said first transistor into saturation in the absence of said second current, said second current taking said first transistor out of saturation when present.

3. The dropout drive reduction circuit of claim 1, wherein said first and third transistors are bipolar transistors, said first transistor having its emitter connected to said input terminal, further comprising a threshold resistance connected between the respective bases of said first and third transistors such that said third transistor's base voltage is equal to the voltage at said input terminal minus the base-emitter voltage of said first transistor minus the voltage dropped across said threshold resistance, the value of said predetermined threshold voltage varying with the value of said threshold resistance.

4. The dropout drive reduction circuit of claim 1, wherein said first and third transistors are bipolar transistors operated in their inverted mode such that the terminals diffused as the respective collectors of said first and third transistors are employed as respective emitters and are connected to said LDO's input and output terminals, respectively.

5. The dropout drive reduction circuit of claim 1, wherein said LDO has a specified dropout voltage and said predetermined threshold voltage is less than said specified dropout voltage.

6. A low dropout voltage regulator (LDO) including a drop-out drive reduction circuit for reducing the magnitude of a current which drives an LDO's pass transistor when the LDO's input voltage is falling and its output is lightly loaded, comprising:

a pass transistor connected between an input voltage terminal and an output voltage terminal of a low dropout regulator and which produces an output voltage at said output voltage terminal in accordance with a drive current received at its control input and an input voltage received at its input voltage terminal, a drive circuit connected to supply said drive current to said pass transistor in accordance with an error voltage received at a first input and a bias current received at a second input, said drive circuit arranged to limit the maximum drive current delivered to said pass transistor in accordance with the magnitude of said bias current, a loop amplifier connected to supply said error voltage to said drive circuit's first input in accordance with a feedback voltage received at an input, a feedback network connected between said output voltage terminal and said loop amplifier input and supplying said feedback voltage to said amplifier, said feedback network, loop amplifier and drive circuit forming a feedback loop that regulates said output voltage, and a dropout drive reduction circuit, comprising:

a bias resistor, a first transistor having its current circuit connected between said input terminal and one terminal of said bias resistor, said first transistor conducting a current to said bias resistor in accordance with a first current applied at its control input, a second transistor having a current circuit connected between the second terminal of said bias resistor and said drive circuit, said second transistor biased with a voltage that varies with the voltage at said input terminal, said first and second transistors forcing a voltage across said bias resistor to produce said bias current, said second transistor conducting said bias current to said drive circuit, and a third transistor having a current circuit connected between said output terminal and said first transistor's control input, said third transistor arranged to conduct a second current to said first transistor's control input when the voltage across said input and output terminals falls below a predetermined threshold voltage, said second current reducing the magnitude of said first current and thereby modulating the current conducted to said bias resistor by said first transistor, said modulating of said current to said bias resistor reducing the magnitude of said bias current and thereby lowering said maximum drive current limit.

7. The LDO of claim 6, wherein said LDO has a specified dropout voltage and said predetermined threshold voltage is less than said specified dropout voltage.

8. A method of preventing excessive pass transistor drive current when a low dropout voltage regulator's input voltage is falling and its output is lightly loaded, comprising the steps of:

driving a pass transistor connected between the input and output terminals of a low dropout regulator (LDO) with a drive current to produce an output voltage at said output terminal, said drive current produced by a drive circuit that receives a bias current and which limits the maximum drive current delivered to said pass transistor in accordance with the magnitude of said bias current, forcing a controlled voltage across a bias resistor to generate said bias current, said controlled voltage established by a first transistor having a current circuit connected between one terminal of said bias resistor and said input terminal and a second transistor having a current circuit connected to the second terminal of said bias resistor and conducting said bias current to said drive circuit, said first transistor driven to conduct current to said bias resistor by a first current applied at its control input and said second transistor driven to conduct said bias current to said drive circuit by a voltage that varies with the voltage at said input terminal, and applying a second current to said first transistor's control input when the voltage across said input terminal and said output terminal drops below a predetermined threshold voltage, said second current reducing the magnitude of said first current and thereby modulating the current conducted to said bias resistor by said first transistor, said modulating of said current to said bias resistor reducing the magnitude of said bias current and thereby lowering said maximum drive current limit.

9. The method of claim 8, wherein said second current is conducted by a third transistor having a current circuit connected between said output terminal and said first transistor's control input and a control input which receives a voltage that varies with the voltage at said input terminal, said third transistor turning on and conducting said second current when the voltage across said input and output terminals drops below said predetermined threshold voltage.

10. The method of claim 9, wherein said first and third transistors are bipolar transistors operated in their inverted mode.

11. The method of claim 9, wherein said first and third transistors are bipolar transistors, said first transistor having its emitter connected to said input terminal, further comprising a threshold resistance connected between the respective bases of said first and third transistors such that said third transistor's base voltage is equal to the voltage at said input terminal minus the base-emitter voltage of said first transistor minus the voltage dropped across said threshold resistance, the value of said predetermined threshold voltage varying with the value of said threshold resistance.

12. The method of claim 8, wherein said first current is of sufficient magnitude to drive said first transistor into saturation in the absence of said second current, said second current taking said first transistor out of saturation when present.

13. The method of claim 8, wherein said LDO has a specified dropout voltage and said predetermined threshold voltage is less than said specified dropout voltage.

* * * * *